US005174564A

United States Patent [19]

Young, III

[11] Patent Number: 5,174,564

[45] Date of Patent: Dec. 29, 1992

[54] TRAINING DEVICE FOR SWINGING AND HITTING ACTIVITIES

[76] Inventor: James H. Young, III, P.O. Box 634 Hwy FM 247 and Allen Rd., Huntsville, Tex. 77342

[21] Appl. No.: 775,180

[22] Filed: Oct. 11, 1991

[51] Int. Cl.[5] ..... A63B 69/40

[52] U.S. Cl. ..... 273/26 C; 273/190 B

[58] Field of Search ..... 273/26 R, 26 C, 29 A, 273/188 R, 190 R, 190 A, 190 B, 190 E, 191 R, 191 A, 191 B, DIG. 17, 188, 183 B, 183 E

[56] References Cited

U.S. PATENT DOCUMENTS

| | | | |
|---|---|---|---|
| 1,126,051 | 1/1915 | McGillicuddy | 273/190 B |
| 2,077,318 | 4/1937 | Goodman | 273/190 B |
| 4,527,982 | 7/1985 | Salzman | 273/190 A |
| 4,817,954 | 4/1989 | Kubo | 273/183 B |
| 4,826,165 | 5/1989 | Bocci | 273/190 C |

FOREIGN PATENT DOCUMENTS

| | | | |
|---|---|---|---|
| 2236530 | 2/1975 | France | 273/190 B |

*Primary Examiner*—Theatrice Brown
*Attorney, Agent, or Firm*—James L. Jackson

[57] ABSTRACT

A swinging and hitting training device for use by athletic participants of golf, baseball and the like includes a mouth receiving member or a chin strap for temporarily fixed engagement with the head of the user. A force transmission element, such as a strap, extends from the head engaging device and is provided with at least one and preferably two strap connections. From the strap connections extend a pair of angularly related adjustable elastic straps having clips at their free extremities for releasable connection to the clothing of the user, particularly at the belt line. During swinging activities for hitting golf balls, baseballs and the like, undesired head movement will impart a force to the resilient straps which force is resisted. The resistance force is capable of being felt by the user, thus enabling self-determination by the user that improper head movement has occurred during swinging. This enables the user to make appropriate corrections to insure that a proper swing takes place during ball hitting activities.

5 Claims, 2 Drawing Sheets

TRAINING DEVICE FOR SWINGING AND HITTING ACTIVITIES

FIELD OF THE INVENTION

This invention relates generally to training devices for sports such as baseball, golf, etc. and more particularly to a training device for development of precision batting or hitting in the game of baseball and other sporting activities where a bat, club, racquet, etc. is swung to hit a moving or stationary ball.

BACKGROUND OF THE INVENTION

Coaches and instructors in the sports of baseball and golf have experienced a measure of success teaching the art or science of properly striking or hitting the ball. It is well known that in each of these activities, the most important function and a typical failing from the standpoint of properly striking the ball is the inability of the participant to maintain the head at a substantially stationary position during swinging of a baseball bat or a golf club. Coaches and fans of these sports have noticed that there seems to be one elementary function necessary to hit the ball no matter what style of stance, swing, bat or club is used. Before anything, the participant must "see" the ball. Thus conventional phrases of encouragement and training such as "watch the ball", "don't over-swing", "watch the ball from the pitcher's release to the bat", "watch the bat hit the ball", "look at the ball, not where you hope to send it" have been employed by coaches for generations with limited success. There is a natural tendency, especially in novices, for the participant to turn the head and/or raise the head during the swing and prior to striking the ball, so as to watch where the ball is intended to go. Unfortunately, when the head is thus turned during the swing, many abnormalities occur which result in errant striking of the ball. Thus, the ball does not typically go where the user intends but rather takes on an errant flight that is the result of these abnormalities.

From the standpoint of firearm shooting, it is well known that one can not hit the target when the sights of the firearm are moving relative to the eye of the user and the intended target. Firearm users may explain the slightest tap on the head, or any kind of interference that moves the sight, causes the firearm to discharge its shot in errant manner relative to the target. Thus, it is well known that the eye must concentrate on both sight and the target at the time the firearm discharges in order for the target to be repeatedly hit. From the standpoint of baseball, the slightest movement of the head during the swing causes the eye of the user to have less than desired contact with the ball, which is the target of the bat. Any movement of the head which causes loss of eye contact with the ball results in the participant swatting aimlessly at the ball and thus either missing or mishitting the ball.

It is also well known that from T-ball, played by young novices, to professional baseball, head-on contact with the ball is the only satisfying result of a swing. Poor or no contact as the participant swings the bat is in many cases described as a "slump". After hitting a home-run, many players have stated "I didn't even hit it hard"; however, the player properly positioned the bat relative to the ball during the swing and thus imparted maximum force and proper direction to the ball, causing its flight to carry the ball out of the park.

Since head movement during swinging is a major cause of improper baseball hitting, it is desirable to provide an efficient means for enabling a player during practicing activities to make a self-determination that the head is not being held steady. It is also desirable to enable a baseball player and the participants of other sporting activities to make a self-determination of the manner by which the head may be maintained substantially stationary during the swing to enable the participant to make self-improvement in batting or swinging activities.

SUMMARY OF THE INVENTION

It is a primary feature of the present invention to provide a novel apparatus intended to be worn by participants in the sports of baseball, golf, etc. and which enables the participant to make a self-determination of proper head position during the swinging of baseball bats, golf clubs, etc.

It is also a feature of this invention to provide a novel apparatus that is worn by sporting participants and which enables the participant to establish by self-determination proper, substantially stationary maintenance of the head position during the swing.

It is another feature of this invention to provide a novel hitting training device intended to be worn by participants of sporting activities and which provides some resistance to head movement during swinging to thus permit the participant to feel the resistance and make appropriate corrections as needed for proper swinging.

Among the several features of this invention is noted the contemplation of a novel hitting or swinging training device which is intended to be worn by athletic participants and which establishes a predetermined relationship between the head and hip or other body structure of the user to thus enable the user to detect and correct improper swinging during training activities.

Briefly, according to the principles of the present invention, the various features of the invention are realized by apparatus having means for attachment to the head structure of an athletic participant, which enables the participant to feel any force which is applied to the device. In one form of the invention, the means for attachment to the head of the participant may take the form of a generally U-shaped mouthguard that is placed into the mouth for engagement by the teeth of the user. From this mouthguard device extends a connecting element through which force is applied to the mouthguard. Means is also provided for adjustably interconnecting the connecting element with the body structure of the user, particularly at the waist and hip and which enables the user to insure predetermined positioning of the head in relation to the body. Such means for adjustable connection may conveniently take the form of elastic straps that are secured at one end to the connecting element and are adapted to be secured at the opposite ends to the body of the user, particularly at the belt-line. The elastic straps are adjustable in length to accommodate the physical dimensions of the user's body. When properly adjusted, if the head of the user should move relative to the body during the batting or hitting swing, the head movement will cause a force to be applied through the connecting element to the head engaging means. Thus, the user will feel this force and recognize that improper head movement has occurred.

At the same time the user will recognize the correction that is necessary to maintain the head substantially stationary during the swing.

An alternative embodiment may be of substantially the same construction as described above with he exception that the means for engaging the head of the user may take the form of a helmet chin strap with the connecting element extending therefrom. The batting or hitting training apparatus of this invention may also take other suitable forms within the spirit and scope of this invention.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

In the Drawings

FIG. 1 is an elevation view of a batting or hitting training device that is constructed in accordance with the present invention and is representative of the preferred embodiment.

FIG. 2 is an elevational view of a batting or hitting training device representing an alternative embodiment of this invention.

DETAILED DESCRIPTION OF PREFERRED EMBODIMENT

Figure 1:
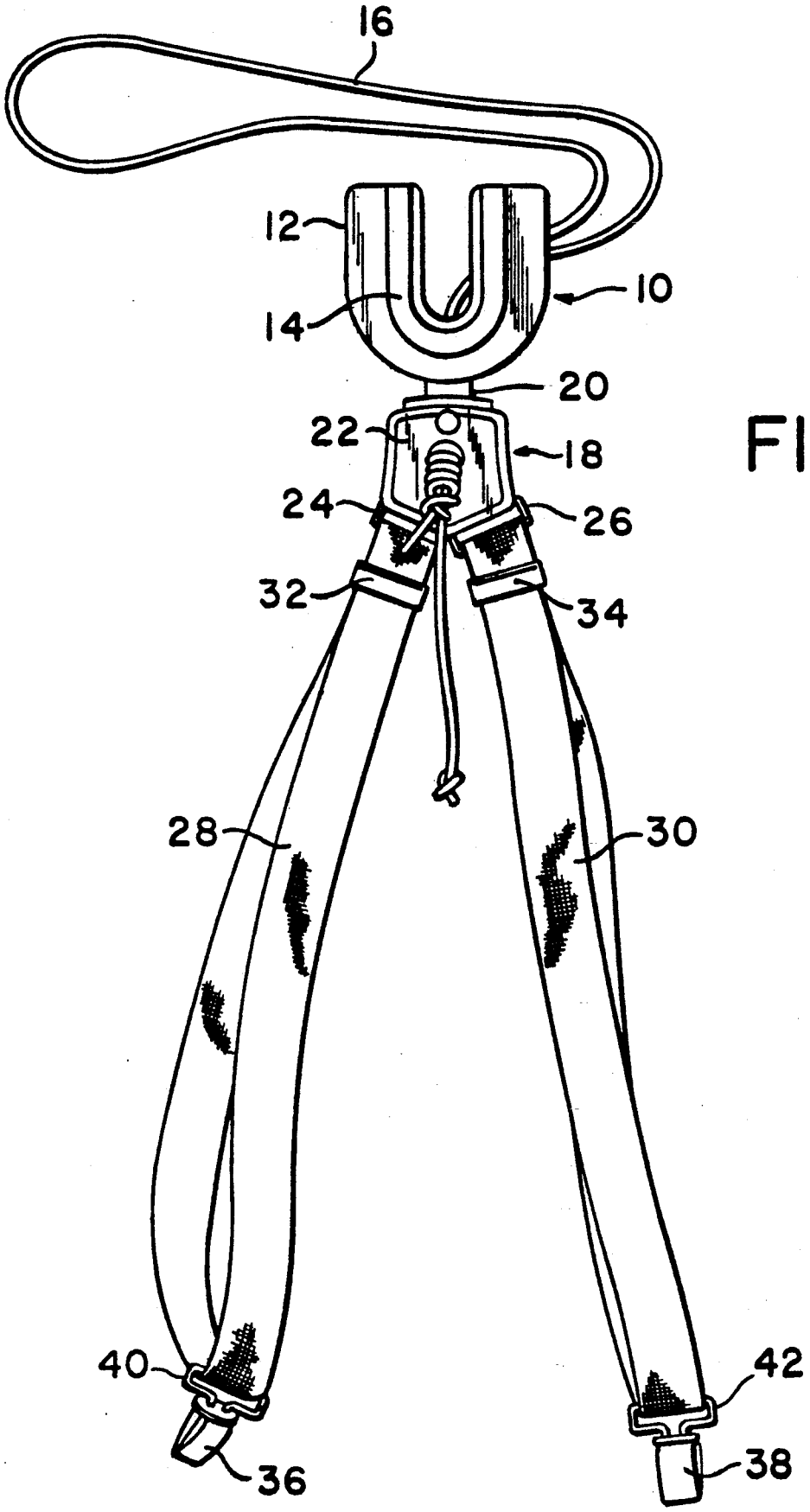

Referring now to the drawings and first to FIG. 1, a batting or hitting training device that embodies the principles of this invention may take the form that is illustrated. The batting or hitting device, illustrated generally at 10 is provided with means for engaging the head of the user and for insuring that any movement of the head during the swing results in application of a force that may be felt by the user. This enables the user to establish correction of the swing to thus ensure that little or no force is felt when a typical swing of the bat, club, etc. is properly executed. According to the design of FIG. 1, the means for engaging the head of the user may conveniently take the form of a mouthguard type device 12 of generally U-shaped configuration and defining a U-shaped trough or groove 14 which receives the teeth of either the maxillary or mandibular dental arch of the user. Though not necessary to swing training activities, the mouthguard 12 may be provided with a lanyard 16 which is positionable about the neck of the user to support the apparatus when it is not being used.

From the mouthguard 12 extends a connecting element shown generally at 18 and incorporating a connecting strap or projection 20 which may be formed integrally with the mouthguard or which may be connected to it in any suitable fashion. The mouthguard and the connecting element 20 may, if desired, be integrally molded from any one of a number of polymer materials that are conventionally utilized as mouthguards for athletes. The connecting element 18 also includes a strap connection device 22 having a pair of strap connectors 24 and 26 provided thereon. The strap connectors respectively receive adjustable elastic straps 28 and 30 which are preferably oriented in diverging relation to one another for orientation to the front and side respectively of the user's body. The straps have adjustment buckles 32 and 34 to enable the lengths of the straps in relation to the strap connection 22 to be individually adjustable according to the body dimensions and desired head position of the user. The adjustable elastic straps are provided at the lower ends with connecting elements 36 and 38 each having strap receiving loops 40 and 42. The connecting elements 36 and 38, if desired, may conveniently take the form of toggle clips or alligator clips such as are typically employed to connect conventional suspenders to trousers. The connecting elements 36 and 38 may also take any other suitable form such as a belt or belt loop connector without departing from the spirit and scope of this invention.

One of the elastic straps 30 may be connected to the clothing of the user, particularly the belt, at or near the center of the body. This strap may be adjusted in length so as to insure that when properly positioned, the head of the user is at a particular downward position. The other adjustable strap 28 is also adapted to be secured to the clothing of the user, particularly the belt in the region of the hip of the user. Thus, if the head of the user is raised from its desired position during the swing, the elastic strap 30 will provide resistance and therefore a force will be applied to the connecting element 20 which will be transmitted through the mouthguard to the head of the user. This force, no matter how slight, will be felt by the user, thus imparting knowledge to the user that the head has been improperly moved in an upward direction during the swing. When the head is properly held steady during the swing, little or no force will be applied through the strap 30 and mouthguard 12 to the head of the user.

Should the head of the user be turned improperly during the swing, the elastic strap 28 will become taut and resist head movement, thus applying a force through the strap 28 and the connecting element 20 to the mouthguard 12. This force, no matter how slight, will also be felt by the user, thus providing the user with the knowledge that the head has been improperly turned during the swing. The user can then practice the swing stroke in such manner that forces are not felt by the resistance of either of the straps 28 or 30, thus insuring that the head of the user has been maintained at a proper downward position and has been maintained steady from the standpoint of rotation during the swing.

The swing training device of this invention provides excellent self-teaching capability from the standpoint of proper swing. Proper teaching of bat or club training is extremely difficult to accomplish by all of the known coaching activities. It will be no longer necessary for the coach to watch the swing of the participant and then try to make the participant aware of the errors that have occurred and to teach the participant the proper swing that should be accomplished. Through use of the apparatus of this invention, the user will be instantly aware through "feel" that improper head movement has taken place during the swing. By repeating the swing and intentionally holding the head at the proper position during the swing, no significant resistance will be induced by the apparatus and thus the participant will understand from the standpoint of feel how to accomplish a proper swing. The result, as has become evident through initial testing of the apparatus of this invention, is that novices and those more experienced can very quickly overcome hitting difficulties that occur due to improper head movement during the swing. The improvement in the hitting capability of novice participants has provided clear indication that the training apparatus of this invention functions well to achieve its desired result.

Figure 2:
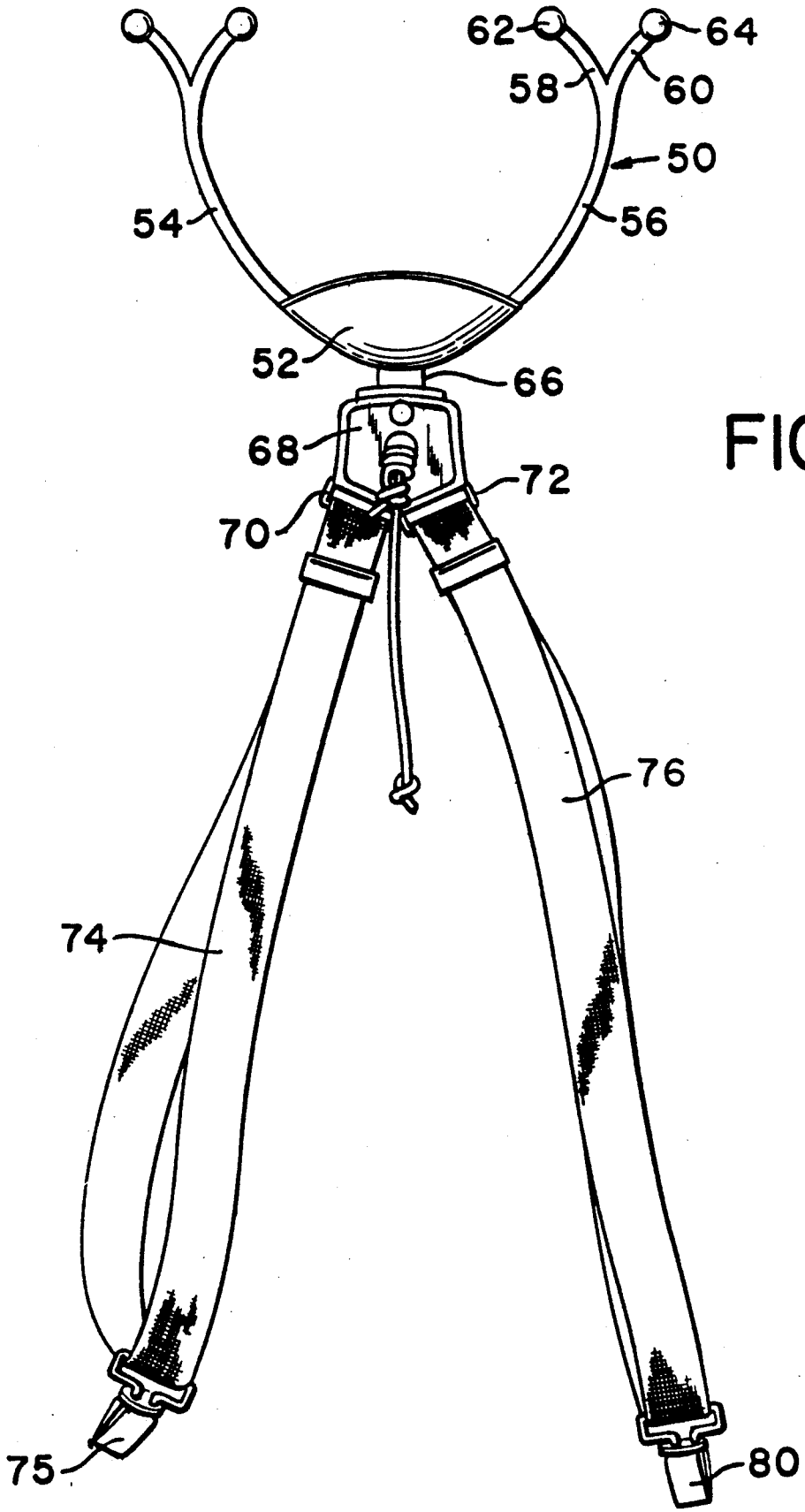

As shown in FIG. 2, an alternative embodiment of this invention any conveniently take the form illustrated generally at 50. According to this embodiment, the means for engaging the head of the user may conveniently take the form of a chin strap system shown generally at 50 incorporating a chin cup 52 such as is typically employed by football players. From the chin cup 52 extends a pair of transverse chin straps 54 and 56 which may have diverging strap sections 58 and 60 with snaps 62 and 64 as the free extremities thereof. The snaps will be adapted for connection to snap receptacles or projections that are affixed to the opposed sides of a helmet device, not shown which is worn by the user.

From the chin cup 52 projects a connection and force transmission element 66 through which forces are transmitted to the chin strap. A strap connector 68 with strap loops 70 and 72 extend from the connecting element and provides for attachment thereto of adjustable elastic straps 74 and 76. Elastic straps 74 and 76 are of the same character of construction as the adjustable straps 28 and 30 of FIG. 1. The lower ends of the adjustable straps will be provided with connecting buckles 78 and 80 to enable the elastic straps to be connected to the clothing, particularly the belt or belt loops of the user. The apparatus of FIG. 2 is utilized in the same manner as described above with respect to FIG. 1.

If the head of the participant is raised or rotated during the swing, the elastic straps 74 and 76 will resist both rotation and upward movement of the head and thereby develop a force that is applied through the strap connector 68 and connecting element 66 to the chin cup 52 of the chin strap assembly. The force is thus transmitted through the lateral straps 54 and 56 to the helmet of the user where the force is readily felt. Thus, the user will be able to repeat proper practice swings in such manner as to insure that little or no force is transmitted by the training device to the helmet worn by the user. In this manner, a proper or improper swing may be readily detected and proper adjustment of the swing may be readily accomplished to insure that the head remains near stationary during athletic swinging activities. In this manner the participant will be readily able to develop a proper swinging stroke, thus enabling the participant to become more effective at proper hitting of the ball.

In view of the foregoing, it is evident that the present invention is one well adapted to attain all of the objects and features hereinabove set forth, together with other objects and features which are inherent in the apparatus disclosed herein.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

What is claimed is:

1. A swinging and hitting training device for use by athletic participants of the sports of golf and baseball, comprising:

(a) a mouth piece adapted to be received in the mouth of the user and adapted to be gripped by the teeth of the user, said mouthpiece having a connector projection extending therefrom and adapted to extend from the mouth of the user for transmitting forces from the head of the user;

(b) a connecting element being fixed to said connector projection and defining a pair of strap connectors thereon;

(c) a pair of elastic straps extending from said connecting element, one of said elastic straps adapted for connection at the front center of the waist of a user and the other of said elastic straps adapted for connection at the side of the waist of a user, said elastic straps resisting movement of the head of the user relative to the body and imparting a force to said strap connecting element in response to undesired head movement of the user during swinging and hitting activities, said force making the user aware of improper swinging; and (d) waist connectors being provided on each of said elastic straps and adapted respectively for connection to the front and to the side of the waist of a user.

2. The swinging and hitting training device of claim 1, wherein:

said mouthpiece is in the form of a mouthguard having a channel formed therein for receiving at least some of the teeth of a user.

3. The swinging and hitting training device of claim 1, wherein:

said strap connectors of said strap connecting element are oriented in angular relation, thereby orienting said pair of straps in diverging relation with one another such that said one of said elastic straps extends from said connecting element to the front center of the waist of a user and said other of said elastic straps extends from said connecting element to the side of the waist of a user.

4. The swinging and hitting training device of claim 1, wherein:

said waist connectors are releasable gripping elements capable of gripping selected portions of the clothing of a user.

5. The swinging and hitting training device of claim 1, including:

a lanyard secured to said swinging and hitting training device and adapted to extend about the neck of a user for support of the training device while the same is not in use.

* * * * *